US007665632B2

(12) United States Patent
Ziesel

(10) Patent No.: US 7,665,632 B2
(45) Date of Patent: Feb. 23, 2010

(54) NOZZLE FLOW SPLITTER

(75) Inventor: Lawrence B. Ziesel, Woodstock, GA (US)

(73) Assignee: The Coca-Cola Company, Atlanta, GA (US)

( * ) Notice: Subject to any disclaimer, the term of this patent is extended or adjusted under 35 U.S.C. 154(b) by 436 days.

(21) Appl. No.: 11/160,467

(22) Filed: Jun. 24, 2005

(65) Prior Publication Data

US 2006/0289563 A1 Dec. 28, 2006

(51) Int. Cl.
*B67D 5/56* (2006.01)

(52) U.S. Cl. ..... 222/129.1; 222/145.1

(58) Field of Classification Search ..... 222/129.1, 222/129.2, 129.3, 129.4, 145.1, 132, 486.5, 222/144.5, 145.5, 145.6, 481.5; 239/110, 239/417.5, 423–424, 425.5
See application file for complete search history.

(56) References Cited

U.S. PATENT DOCUMENTS 2,018,389 A * 10/1935 Wagner ..... 222/129.3
4,262,371 A * 4/1981 Berry et al. ..... 4/678
4,266,726 A * 5/1981 Brown et al. ..... 239/406
4,392,588 A * 7/1983 Scalera ..... 222/129.4
4,676,401 A * 6/1987 Fox et al. ..... 222/1
5,033,651 A 7/1991 Whigham et al.
5,186,363 A 2/1993 Haynes et al.
5,526,959 A * 6/1996 Green ..... 222/129.4
6,045,007 A 4/2000 Simmons et al.
6,253,963 B1 * 7/2001 Tachibana ..... 222/129.1
6,321,938 B1 * 11/2001 Edwards et al. ..... 222/1
6,345,729 B1 * 2/2002 Santy, Jr. ..... 222/1
6,401,981 B1 * 6/2002 McCann et al. ..... 222/129.1
7,108,156 B2 * 9/2006 Fox ..... 222/129.1
2004/0040983 A1 3/2004 Ziesel

* cited by examiner

*Primary Examiner*—Frederick C. Nicolas
(74) *Attorney, Agent, or Firm*—Sutherland Asbill & Brennan LLP

(57) ABSTRACT

A flow splitter for use with a dispensing nozzle. The dispensing nozzle dispenses a first fluid and a second fluid. The flow splitter may include an inner chamber for collecting the first fluid and an outer chamber for collecting the second fluid. The inner chamber may include an internal vent so as to vent air into the inner chamber.

20 Claims, 3 Drawing Sheets

NOZZLE FLOW SPLITTER

TECHNICAL FIELD

The present application relates generally to nozzles for beverage dispensers and more particularly relates to a flow splitter so as to split the fluid flow from a nozzle between syrup and water so as to determine the existing flow ratio.

BACKGROUND OF THE INVENTION

Current post-mix beverage dispenser nozzles generally mix a stream of syrup, concentrate, bonus flavor, or other type of flavoring ingredient with water or other type of diluent. The streams may be mixed by shooting the syrup stream down the center of the nozzle with the water stream flowing around the outside of the syrup stream. The syrup stream is directed downward with the water stream as the streams drop into the cup. One known dispensing nozzle system is shown in commonly owned U.S. Pat. No. 5,033,651 to Whigham, et al., entitled "Nozzle For Post Mix Beverage Dispenser", incorporated herein by reference.

Recent developments have led to a modular dispensing nozzle in which the water stream travels down a central structure while a syrup stream is shot at the water stream and the central structure. An example of this configuration is shown in commonly owned U.S. Patent Application Publication No. US 2004/0040983 A1 to Ziesel, entitled "Dispensing Nozzle", incorporated herein by reference.

Regardless of the configuration of the nozzle, the final beverage produced by the beverage dispenser generally may be tested so as to ensure that the proper ratio of syrup or concentrate to water or diluent is flowing through the nozzle. This testing generally involves splitting the fluid flow from the nozzle between the syrup and the concentrate streams and the water or the diluent streams.

What is desired, therefore, is a device to split the flow of a beverage as it exits the nozzle between the syrup and the concentrate streams and the water or the diluent streams. The device preferably can adapt to the modular dispenser nozzle configuration described above or any other type of beverage dispenser nozzle.

SUMMARY OF THE INVENTION

The present application thus describes a flow splitter for use with a dispensing nozzle. The dispensing nozzle dispenses a first fluid and a second fluid. The flow splitter may include an inner chamber for collecting the first fluid and an outer chamber for collecting the second fluid. The inner chamber may include an internal vent so as to vent air into the inner chamber.

The inner chamber may include means to connect the flow splitter to the dispensing nozzle. The inner chamber may include an angled floor and one or more outlet holes so as to drain the inner chamber. The outlet holes may lead to an extended drain. The vent may include a lid. The outer chamber may include an angled floor. The angle may be about a forty-five degree angle (45°). The outer chamber may include one or more outlet holes so as to drain the outer chamber. The outlet holes may lead to an extended drain.

The present application further may describe a flow splitter for use with a dispensing nozzle that dispenses a syrup flow and a water flow. The flow splitter may include an inner chamber for collecting the water flow. The inner chamber may include an inner drain so as to drain the inner chamber and an internal vent so as to vent air into the inner chamber.

The flow splitter further may include an outer chamber for collecting the syrup flow. The outer chamber may include an angled floor and a drain so as to drain the outer chamber.

The inner chamber may include means to connect the flow splitter to the dispensing nozzle. The inner chamber also may include an inner angled floor. The vent may include a lid. The angled floor of the outer chamber may include about a forty-five degree angle (45°).

The present application also may describe a method for splitting a water stream and a syrup stream with a flow splitter from a modular dispenser nozzle having a main body, a water module, and a number of syrup modules. The method may include the steps of removing the water module from the main base, connecting the flow splitter to the main base, flowing the water stream from the main body into an inner compartment of the flow splitter, draining the inner compartment of the flow splitter, flowing the syrup stream from one of the syrup modules into an outer compartment of the flow splitter, and draining the outer compartment of the flow splitter. The method further may include the step of venting the inner compartment while draining the inner compartment and the step of comparing the ratio of the water stream and the syrup stream.

These and other features of the current invention will become apparent to one of ordinary skill in the art upon review of the following detailed description when taken in conjunction with the drawings and the appended claims.

BRIEF DESCRIPTION

DETAILED DESCRIPTION

Figure 1:
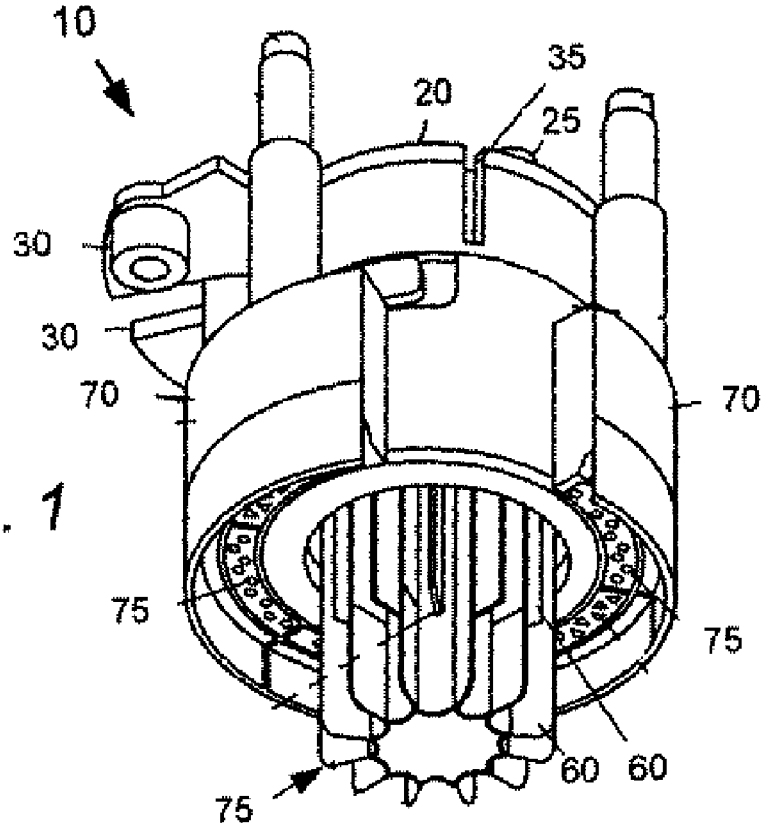
FIG. 1 is a perspective view of a modular dispensing nozzle that may be used with the flow splitter described herein.
Figure 2:
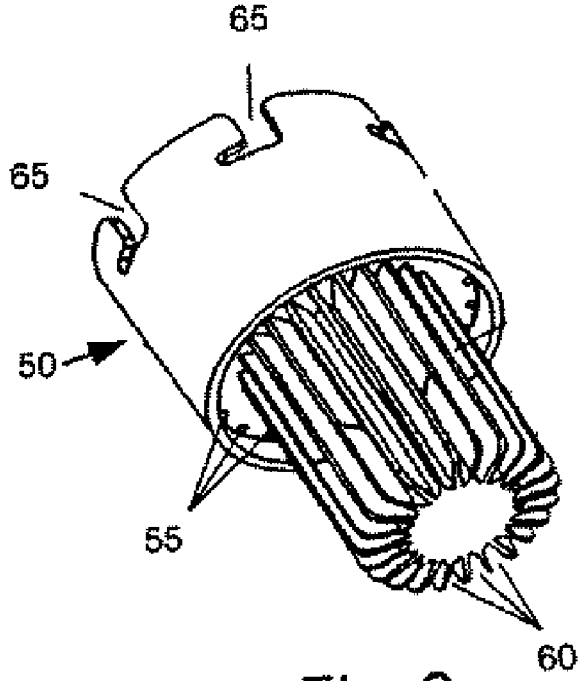
FIG. 2 is a perspective view of a water module of the modular dispensing nozzle of FIG. 1.
Figure 3:
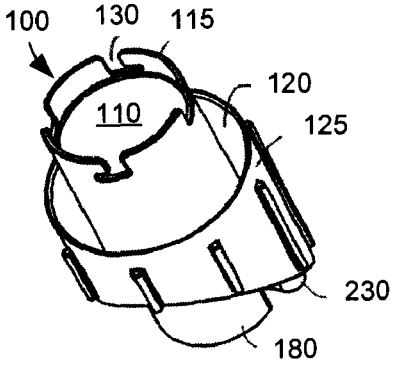
FIG. 3 is a perspective view of a flow splitter as is described herein.
Figure 4:
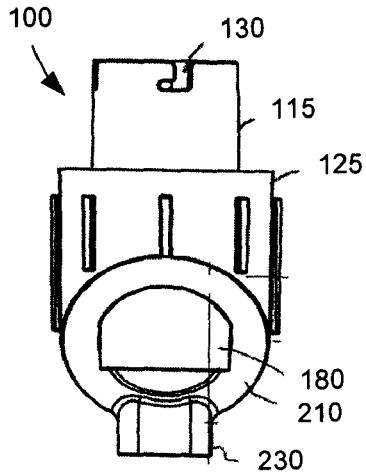
FIG. 4 is a side plan view of the flow splitter of FIG. 3
Figure 5:
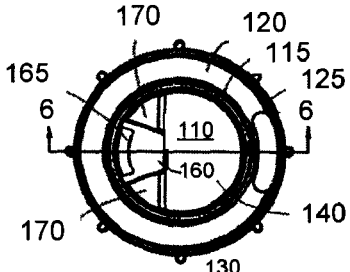
FIG. 5 is a top plan view of the flow splitter of FIG. 3.
Figure 6:
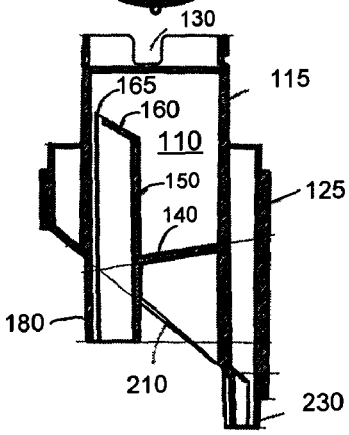
FIG. 6 is a side cross-sectional view of the flow splitter of FIG. 3.
Figure 7:
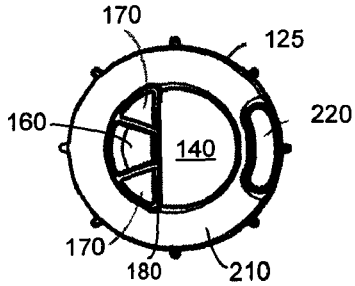
FIG. 7 is a bottom plan view of the flow splitter of FIG. 3.

Referring now to the drawings, in which like numerals refer to like elements throughout the several views, FIGS. 1 and 2 show a modular dispenser nozzle 10 that may be used with a flow splitter 100 as will be described herein. As described above, an example of the modular dispensing nozzle 10 is described in U.S. Patent Application Publication No. US 2004/0040983 and is incorporated herein by reference. Similar types of dispensing nozzles also may be used. Likewise, any type of beverage dispenser also may be used herein.

Briefly described, the modular dispensing nozzle 10 may include a main body 20. The main body 20 may be directly connected to the water circuit of a conventional beverage dispenser. The main body 20 may define one or more water pathways 25 therethrough. For example, one pathway 25 may be used for soda water (carbonated water) while one pathway 25 may be used for still water. We use the term "water" herein to refer to either or both still and soda water.

The main body 20 also may have one or more flanges 30 attached thereto. The flanges 30 may be used to attach the main body 20 to the beverage dispenser via screws or other types of connection means. The main body 20 also may have a number of grooves 35 positioned therein. The grooves 35 will permit the attachment of the syrup modules as will be described in more detail below. The grooves 35 can take any convenient shape. The main body 20 also may include a number of protrusions 40. The protrusions 40 are largely button shaped, although any convenient shape may be used. The protrusions 40 permit the attachment of a water module as will be described in more detail below and/or the attachment of the flow splitter 100 as also will be described in more detail below.

The modular dispensing nozzle 10 further may include a water module 50. The water module 50 may be attachable to the main body 20. The water module 50 may include a number of internal pathways 55 in communication with the water pathways 25 of the main body 20. The water module 50 further may include a series of ribs 60 that may extend below the internal pathways 55. The ribs 60 are positioned such that the water may flow out of the water module 50 via the internal pathways 55 and travel down along and between the ribs 60. The water module 50 also may have a number of indentations 65 formed therein so as to mate with the protrusions 40 of the main body 20. Other joinder means also may be used.

The modular dispensing nozzle 10 further may include a number of syrup modules 70. The syrup modules 70 may be attachable to the main body 20 via the grooves 35 therein. Other joinder means also may be used. Any number of syrup modules 70 may be used. The syrup modules 70 each may have a number of outlet holes 75 formed therein. The outlet holes 75 and each of the syrup modules 70 may accommodate fluids with differing flow characteristics. The modular dispensing nozzle 10 as a whole thus may be able to accommodate a number of beverages with different viscosities and other types of flow characteristics.

The modular dispensing nozzle 10 described herein is for the purpose of example only. Other types of dispensing nozzles 10 also may be used with the flow splitter 100 as is described herein.

FIGS. 3 through 7 show an example of the flow splitter 100 described herein. The flow splitter 100 generally may be a single piece element. Alternatively, the flow splitter 100 may be made of individual elements that are fixably attached to each other. The flow splitter 100 may be manufactured in an injection molding process or via similar types of manufacturing processes. The flow splitter 100 may be made out of ABS (Acrylonitrile Butadiene Styrene), polycarbonate, or similar types of plastic materials. Alternatively, non-corrosive metals or other types of substantially rigid materials also may be used.

The flow splitter 100 may have two chambers, an inner chamber 110 and an outside chamber 120. The inside chamber 110 may be defined by an inner chamber wall 115. The inner chamber wall 115 may be substantially circular in shape and may be sized so as to accommodate the main body 20 of the modular dispensing nozzle 10 or a similar type of structure.

The inner chamber 110 may have a number of indentations 130 or other type of connection element positioned thereon. Similar to the indentations 65 of the water module 50 of the modular dispensing nozzle 10 described above, these indentations 130 may be sized to accommodate the protrusions 40 of the main body 20 of the modular dispensing nozzle 10 or a similar type of structure. Other types of joinder means may be used herein.

The inner chamber 110 may have a lower floor 140 formed therein. The lower floor 140 may be angled slightly towards one end of the inner chamber 110. As defined by the lower floor 140, the inner chamber 110 may have a suitable depth so as to permit soda water to expand somewhat as it emerges from the water circuit of the beverage dispenser.

The inner chamber 110 further may have a vent 150 positioned therein. The vent 150 may be a tubular structure or a similar structure that extends along most of the length of the inner chamber 110 and continues past the lower floor 140. The vent 150 may have a lid 160 positioned partially across the top thereof. The lid 160 may serve to deflect soda water as it emerges from the water module 50 of the modular dispensing nozzle 10 or a similar type of structure and may force the water into the inner chamber 110. The lid 160 may only partially cover the vent 150 so as to define an aperture 165 positioned therein so as to allow air to vent. Some water also may travel through the aperture 165 and the vent 150.

Positioned on either side of the vent 150 may be a pair of outlet holes 170. The outlet holes 170 may be positioned within the lower floor 140 of the inner chamber 110 and continue downward along side the vent 150. The outlet holes 170 and the vent 150 may form a drain 180 that extends down below the lower floor 140 and out of the inner chamber 110.

The inner chamber wall 115 and an outer chamber wall 125 may define the outer chamber 120. The outer chamber wall 125 may be substantially circular in shape and may be sized so as to accommodate the syrup modules 70 of the modular dispensing nozzle 10 or a similar type of structure. The outer wall 125 may have a number of ribs 200 or other types of protrusions thereon so as to assist in applying the flow splitter 100 to the modular dispensing nozzle 10 or a similar type of structure.

The outer chamber 120 also may have a lower floor 210. The lower floor 210 may be angled at about forty-five degrees (45°) or at any other acceptable angle. The angle of the lower floor 210 assists in draining the syrup out of the outer chamber 120. The lower floor 210 may lead to an outlet hole 220. The outlet hole 220 also may lead to a drain 230 that extends downward below the lower floor 210 and out of the outer chamber 120.

Figure 8:
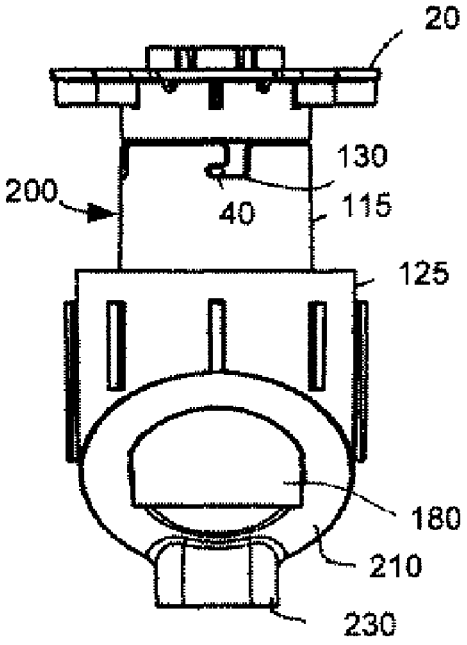
FIG. 8 is a side plan view of the flow splitter as described herein attached to the base of a modular dispensing nozzle.
Figure 9:
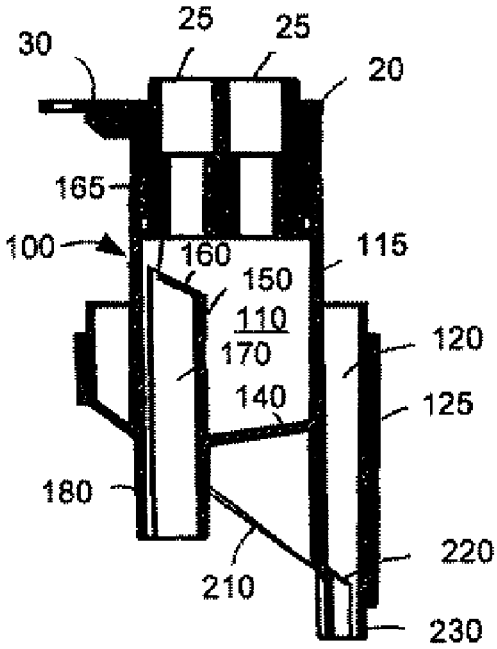
FIG. 9 is a side cross-sectional view of the flow splitter of FIG. 8 and the modular nozzle.

In use as is shown in FIGS. 8 and 9, the water module 50 of the modular dispensing nozzle 10 or any similar type of structure may be removed from the main body 20 by rotating the water module 50 such that the indentations 65 clear the protrusions 40 of the main body 20. The flow splitter 100 then may be attached to the main body 20 of the modular dispensing nozzle 10 in the same manner. Namely, the indentations 130 of the flow splitter 100 may be attached to the protrusions 40 of the main body 20. Other joinder means also may be used. When so positioned, the water pathways 25 of the main body 20 of the modular dispensing nozzle 10 are positioned within the inner chamber 110 of the flow splitter 100. Likewise, either the syrup pathways or the syrup modules 70 of the modular dispensing nozzle 10 align with the outer chamber 120.

The water and syrup circuits of the beverage dispenser thus then may be activated. The water flows into the inner chamber 110 of the flow splitter 100. The water does not flow directly through the vent 150 because of the lid 160. The inner chamber 110 has a sufficient depth such that the soda water may expand and reduce in volume rather than shooting out of the inner chamber 110. The water may then flow through the outlet holes 170 of the lower floor 140 and into the drain 180. The vent 150 allows air to be pulled into the inner chamber 110 thereby allowing the water to drain out quickly. Likewise, the angled lower floor 140 also allows the water to drain freely.

The syrup also may flow into the outer chamber 120, down the angled lower floor 210, into the outlet hole 220, and through the drain 230. The steep forty-five degree angle (45°) or so of the lower floor 210 of the outer chamber 120 ensures that the syrup drains out quickly. The flows thus are separated and may be gathered into two discrete containers, a ratio cup, or otherwise. The syrup to water ratio may be determined via conventional means.

The flow splitter 100 described herein thus provides complete water drainage via the angled lower floor 140 and the use of the vent 150 in the inner chamber 110. Likewise, the flow splitter 100 provides complete syrup drainage via the use of the angled lower floor 210 in the outer chamber 120. Complete drainage should provide for more accurate and faster ratio measurements. The outer and inner chambers 110, 120 also can take different configurations than as shown in the examples herein.

The flow splitter 100 described herein also provides for single placement testing on a multi-flavor nozzle 10. In other words, even if the nozzle 10 has multiple syrup modules 70, each ratio can be tested without removing the flow splitter 100.

It should be apparent that the foregoing relates only to the preferred embodiments of the present invention and that numerous modifications and changes may be made herein without departing from the general spirit and scope of the invention as defined by the following claims and the equivalents thereof.

What is claimed is:

1. A flow splitter for use with a dispensing nozzle that dispenses a first fluid and a second fluid, comprising:
- an inner chamber for collecting the first fluid;
- said inner chamber comprising an internal vent to vent air into said inner chamber;
- an outer chamber for collecting the second fluid; and
- means to releasably connect the flow splitter to the dispensing nozzle so that the flow splitter can separate the first fluid and the second fluid.

2. The flow splitter of claim 1, wherein said inner chamber comprises an angled floor.

3. The flow splitter of claim 1, wherein said inner chamber comprises one or more outlet holes so as to drain said inner chamber.

4. The flow splitter of claim 3, wherein said one or more outlet holes lead to an extended drain.

5. The flow splitter of claim 1, wherein said vent comprises a lid.

6. The flow splitter of claim 1, wherein said outer chamber comprises an angled floor.

7. The flow splitter of claim 6, wherein said angled floor comprises about a forty-five degree angle (45°).

8. The flow splitter of claim 1, wherein said outer chamber comprises one or more outlet holes so as to drain said outer chamber.

9. The flow splitter of claim 8, wherein said one or more outlet holes lead to an extended drain.

10. The flow splitter of claim 1, wherein said internal vent is defined at least in part by a wall that extends upward through at least a portion of said inner chamber.

11. A flow splitter for use with a dispensing nozzle that dispenses a syrup flow and a water flow, comprising:
- an inner chamber for collecting the water flow;
- said inner chamber comprising an inner drain so as to drain said inner chamber;
- said inner chamber comprising an internal vent to vent air into said inner chamber, said internal vent comprising an exterior wall that extends upward through at least a portion of said inner chamber; and
- an outer chamber for collecting the syrup flow;
- said outer chamber comprising an angled floor and an outer drain so as to drain said outer chamber.

12. The flow splitter of claim 11, wherein said inner chamber comprises means to connect the flow splitter to the dispensing nozzle.

13. The flow splitter of claim 11, wherein said inner chamber comprises an inner angled floor.

14. The flow splitter of claim 11, wherein said vent comprises a lid.

15. The flow splitter of claim 11, wherein said angled floor comprises about a forty-five degree angle (45°).

16. A system comprising:
- a dispensing nozzle that dispenses a syrup flow and a water flow; and
- a flow splitter comprising:
  - an inner chamber for receiving the water flow, the inner chamber comprising an internal vent to vent air into the inner chamber;
  - an outer chamber for collecting the syrup flow; and
  - means to releasably connect the flow splitter to the dispensing nozzle so that the flow splitter can separate the syrup flow and the water flow.

17. The system of claim 16, wherein the internal vent is defined at least in part by a wall that extends upward through at least a portion of the inner chamber.

18. The system of claim 16, wherein:
- the inner chamber further comprises an inner drain; and
- the outer chamber further comprises an outer drain.

19. The system of claim 18, wherein:
- the inner chamber further comprises an angled floor; and
- the outer chamber further comprises an angled floor.

20. The system of claim 19, wherein the internal vent comprises:
- a lid; and
- a wall that extends upward through at least a portion of the inner chamber.

* * * * *